US006883187B2

(12) United States Patent
Cornwall

(10) Patent No.: US 6,883,187 B2
(45) Date of Patent: Apr. 26, 2005

(54) TOILET FLANGE ASSEMBLY

(76) Inventor: Kenneth R. Cornwall, 1020 Vintage Club Dr., Duluth, GA (US) 30097

( * ) Notice: Subject to any disclaimer, the term of this patent is extended or adjusted under 35 U.S.C. 154(b) by 79 days.

(21) Appl. No.: 10/145,339

(22) Filed: May 14, 2002

(65) Prior Publication Data

US 2005/0034227 A1 Feb. 17, 2005

(51) Int. Cl.[7] ..... E03D 11/17

(52) U.S. Cl. ..... 4/252.5; 4/252.6; 4/252.1; 285/56; 285/57

(58) Field of Search ..... 4/252.5, 252.1, 4/252.2, 252.3, 252.4, 252.6; 285/56, 57, 285/58, 59, 60

(56) References Cited

U.S. PATENT DOCUMENTS

| | | | | |
|---|---|---|---|---|
| 879,176 A | | 2/1908 | Jackson | |
| 2,899,690 A | * | 8/1959 | Clifford | 4/252.4 |
| 3,012,252 A | * | 12/1961 | Gaddy | 4/252.5 |
| 3,501,172 A | | 3/1970 | Pickard | |
| 4,059,289 A | | 11/1977 | Morris et al. | |
| 4,184,702 A | | 1/1980 | Morris | |
| 4,406,480 A | | 9/1983 | Izzi | |
| 4,423,526 A | | 1/1984 | Izzi, Sr. | |
| 4,482,161 A | | 11/1984 | Izzi, Sr. | |
| 4,515,398 A | * | 5/1985 | Machon, Sr. | 285/59 |
| 4,757,560 A | * | 7/1988 | Grimstad | 4/417 |
| 5,421,036 A | | 6/1995 | Stevens et al. | |
| 6,519,784 B2 | * | 2/2003 | Carwile | 4/252.5 |

* cited by examiner

*Primary Examiner*—Amanda F. Wieker
(74) *Attorney, Agent, or Firm*—Mary M. Moyne; Ian C. McLeod

(57) ABSTRACT

A flange assembly (10) for connecting a plumbing fixture to a drain pipe (106) in a fluid sealing relationship. The flange assembly includes a ring (12), an extension (20), a gasket (24) and a connector pipe (30). The extension extends outward from the top surface (12A) of the ring and the connector pipe extends outward from the bottom surface (12B) of the ring. The gasket is mounted over the end of the extension opposite the ring. The top wall (24A) of the gasket has an opening (26) which allows access to the center bore (22) of the extension. The waste outlet (104) of the plumbing fixture is inserted through the opening (26) in the top wall of the gasket into the center bore of the extension. When the waste outlet is inserted into the opening in the gasket, the gasket forms a seal between the waste outlet and the extension.

23 Claims, 3 Drawing Sheets

TOILET FLANGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates to a toilet flange assembly which connects the waste outlet of a toilet with the drain pipe of the sewer system. In particular, the present invention relates to a toilet flange assembly having a resilient gasket which provides a fluid tight seal between the waste outlet of the toilet and the drain pipe.

(2) Description of the Related Art

In the past, to prevent sewer gases and other fluids from escaping the drain pipe at the connection of the drain pipe to the plumbing fixture, a gasket was compressed between the plumbing fixture and the drain pipe. In relation to toilets, gaskets have been compressed between the underside of the base of the toilet, adjacent the waste outlet, and the toilet flange and/or between the waste outlet and the inner surface of the opening of the toilet ring or coupling. Since the seal is formed by compression of the gasket, the sealing effect of the gasket is destroyed and can be lost if the toilet becomes loose or rocks. In addition, these gaskets were usually constructed of wax which deforms upon use and which can not be reused upon removal of the toilet. Another disadvantage of a wax gasket is that the sealing ability is often destroyed in hot areas due to melting of the wax. Illustrative of such gaskets are U.S. Pat. No. 879,176 to Jackson; U.S. Pat. No. 3,501,172 to Pickard; U.S. Pat. No. 4,406,480 to Izzi and U.S. Pat. No. 5,421,036 to Stevens et al.

The related art has also shown a variety of coupling devices for connecting the waste outlets of plumbing fixtures such as toilets to drain pipes of sewer systems in a sealing relationship. The coupling of U.S. Pat. No. 4,184,702 to Morris has an adaptor with an opening for receiving the waste outlet of the plumbing fixture. An o-ring seal is positioned within a groove about the opening. When the waste outlet is inserted into the opening, the o-ring seal forms a fluid seal between the opening and the waste outlet.

The connector of U.S. Pat. No. 3,012,252 to Gaddy has a bell section having the sealing gasket and a spigot section which extends into the waste pipe. The bell section includes an annular side wall and an upwardly facing shoulder. The side wall and annular shoulder form a seat for the gasket formed of a resilient material. When the horn of the toilet is inserted into the opening well of the bell section and secured in place, the gasket is compressed between the lower edge of the horn and the shoulder to provide a tight seal between the horn and the connector.

Further, the coupling of U.S. Pat. No. 4,059,289 to Morris et al has a fluid sealing member positioned in a sleeve and gasket compression member. The sealing member has a sleeve portion and a flange portion and is constructed of an elastomeric material. The waste outlet of the plumbing fixture is inserted into the coupling such that the sleeve portion of the sealing member is compressed between the compression member and the waste outlet to create a fluid seal therebetween. The flange portion of the sealing member is compressed between the rim of the compression member and the plumbing fixture. The coupling is mounted over the drain pipe such that the top of the drain pipe abuts the end of the waste outlet and the sleeve portion of the sealing member is compressed between the compression member and the drain pipe to form a fluid sealing relationship therebetween.

In addition, the related art has shown a variety of gaskets for use in providing a seal between an outlet of a plumbing fixture and a drain pipe. The gasket of U.S. Pat. No. 4,423,526 to Izzi, Sr. is constructed of a material having memory which allows the toilet to be removed and replaced without requiring a new gasket. The gasket has the same diameter as the base of the toilet and has a central outlet opening to receive the toilet outlet horn. A depending lower outer edge of the opening extends into and forms a seal with the drain pipe. The gasket of U.S. Pat. No. 4,482,161 to Izzi, Sr. rests upon and frictionally grips the flange resting on the floor surface. The gasket has a downwardly extending central opening shaped to sealingly engage both the toilet bowl horn and the flange central aperture. Both of the Izzi, Sr. gaskets extend over and cover the flange and are compressed between the base of the toilet and the flange.

There remains the need for a toilet flange assembly which includes a gasket which is easy to install and which can be reused for removal and replacement of the toilet.

SUMMARY OF THE INVENTION

A flange assembly for connecting a plumbing fixture to a drain pipe in a fluid sealing relationship. The flange assembly includes a ring, an extension, a gasket and a connector pipe. The extension extends outward from the top surface of the ring around the opening in the ring. The extension has a center bore which is in fluid communication with the opening of the ring. The connector pipe extends outward from the bottom surface of the ring in a direction opposite the extension. The gasket is mounted over the end of the extension opposite the ring. The top wall of the gasket extends inward to cover a portion of the center bore at the first end of the extension. The top wall of the gasket has an opening which is co-axial with the center bore and allows access to the center bore from the first end of the extension. The diameter of the opening of the gasket is less than the diameter of the center bore at the first end of the extension. The diameter of the opening of the gasket is also less than the outer diameter of the waste outlet of the plumbing fixture. The flange assembly is connected to the drain pipe by the connector pipe. The connector pipe can extend into or around the drain pipe. In one (1) embodiment, a coupling is used to connect the flange assembly to the drain pipe.

The waste outlet of the plumbing fixture is inserted through the opening in the top wall of the gasket into the center bore of the extension. The center bore of the extension can be tapered to help guide the waste outlet toward the center of the center bore. The gasket is constructed of a resilient, flexible material such that when the waste outlet is inserted into the opening in the gasket, the gasket forms a seal between the waste outlet and the extension. In one (1) embodiment, the plumbing fixture is a toilet. In this embodiment, the ring of the flange assembly is similar to a standard toilet flange and has slots for receiving the toilet bolts.

The present invention relates to a flange assembly for use in connecting a plumbing fixture to a drain pipe, which comprises: a flange having a first side and a second side with an opening extending between the sides; an extension extending outward from the first side of the flange and having a center bore in fluid communication with the opening of the flange; and a gasket mounted on the extension and extending inward such as to cover a portion of the center bore of the extension and having an opening in fluid contact with the center bore of the extension wherein in use, the flange assembly is mounted on the drain pipe such that the drain pipe is in fluid communication with the opening of the flange adjacent the second side of the flange and the plumbing fixture is positioned on the flange assembly with a waste outlet of the plumbing fixture extending through the opening in the gasket and into the center bore of the extension such that the gasket forms a fluid tight seal between the waste outlet of the plumbing fixture and the center bore of the extension.

Further, the present invention relates to a toilet flange assembly for connecting a toilet to a drain pipe, which comprises: a ring having a first side and a second side with an opening extending between the sides; an extension having a first end and a second end with the second end connected to the ring and extending outward from the first side of the ring and having a center bore in fluid communication with the opening of the ring; a gasket mounted over the first end of the extension opposite the ring and having an opening, the opening having a diameter less than a diameter of the center bore of the extension at the first end of the extension; and a connector pipe having a first end and a second end with the first end connected to the opening of the ring and with the second end extending outward from the second side of the ring wherein in use, the connector pipe is connected to the drain pipe and the toilet is positioned on the flange assembly with a waste outlet of the toilet extending through the opening of the gasket and into the center bore of the extension such that the gasket forms a fluid tight seal between the waste outlet of the toilet and the center bore of the extension.

Still further, the present invention relates to a method for forming a fluid gasket between a waste outlet of a toilet and a drain pipe which comprises the steps of: providing a flange assembly including a ring having a first side and a second side with an opening extending between the sides, an extension extending outward from the first side of the ring and having a center bore in fluid contact with the opening of the ring, and a gasket mounted on the extension and extending inward such as to cover a portion of the center bore of the extension and having an opening in fluid contact with the center bore of the extension; connecting the opening of the ring to the drain pipe such that the drain pipe is adjacent the second side of the ring; and mounting the toilet on the assembly such that the waste outlet of the toilet extends into the center bore of the extension wherein the gasket flexes to accommodate the outlet and forms a fluid tight seal between the waste outlet of the toilet and the flange assembly.

The substance and advantages of the present invention will become increasingly apparent by reference to the following drawings and the description.

DESCRIPTION OF THE PREFERRED EMBODIMENTS

Figure 1:
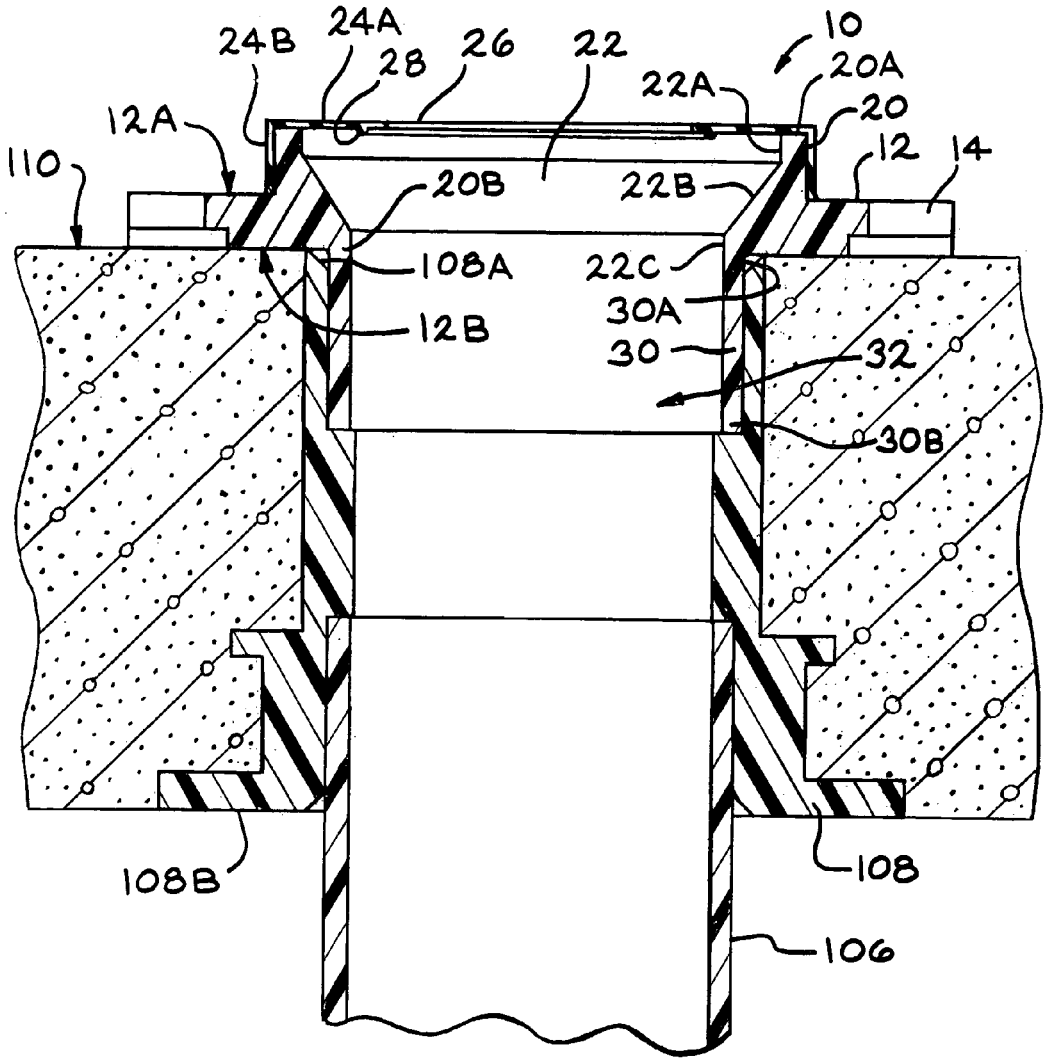
FIG. 1 is a cross-sectional view of the flange assembly 10 mounted on a floor 110 and connected to the drain pipe 106.
Figure 2:
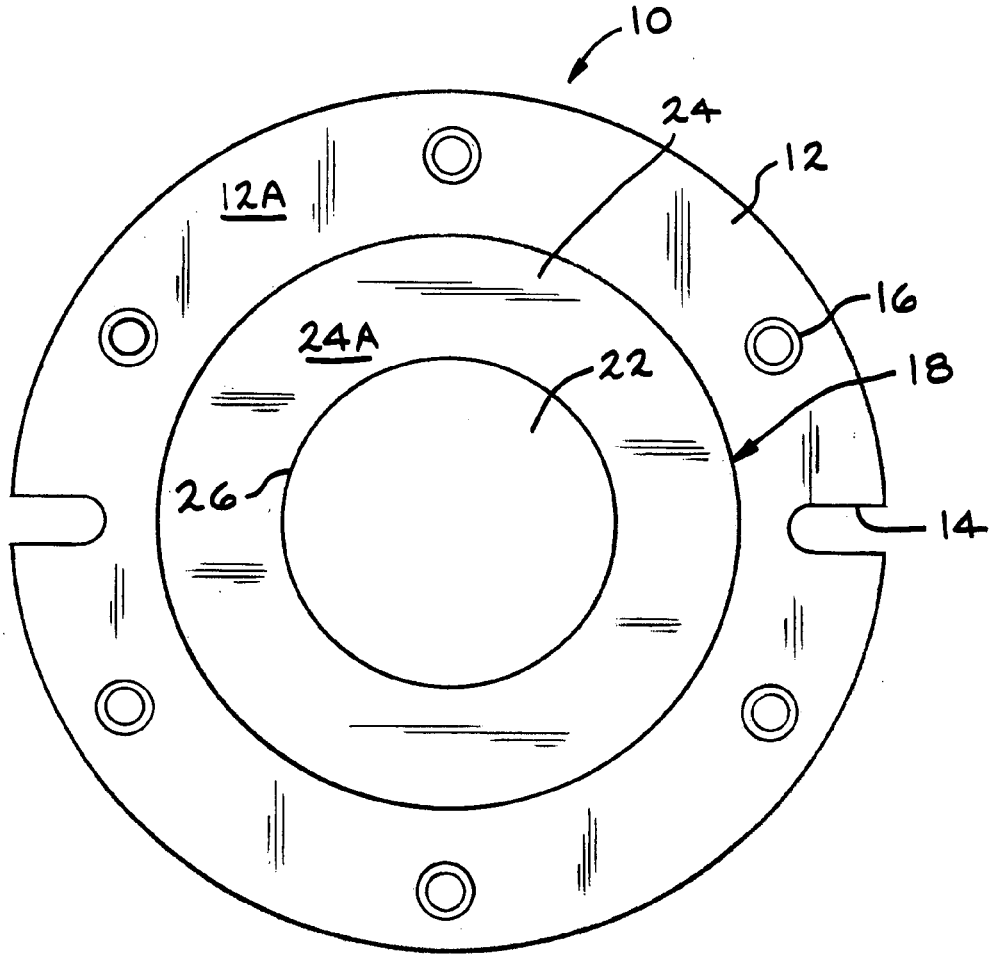
FIG. 2 is a top view of the flange assembly 10.
Figure 3:
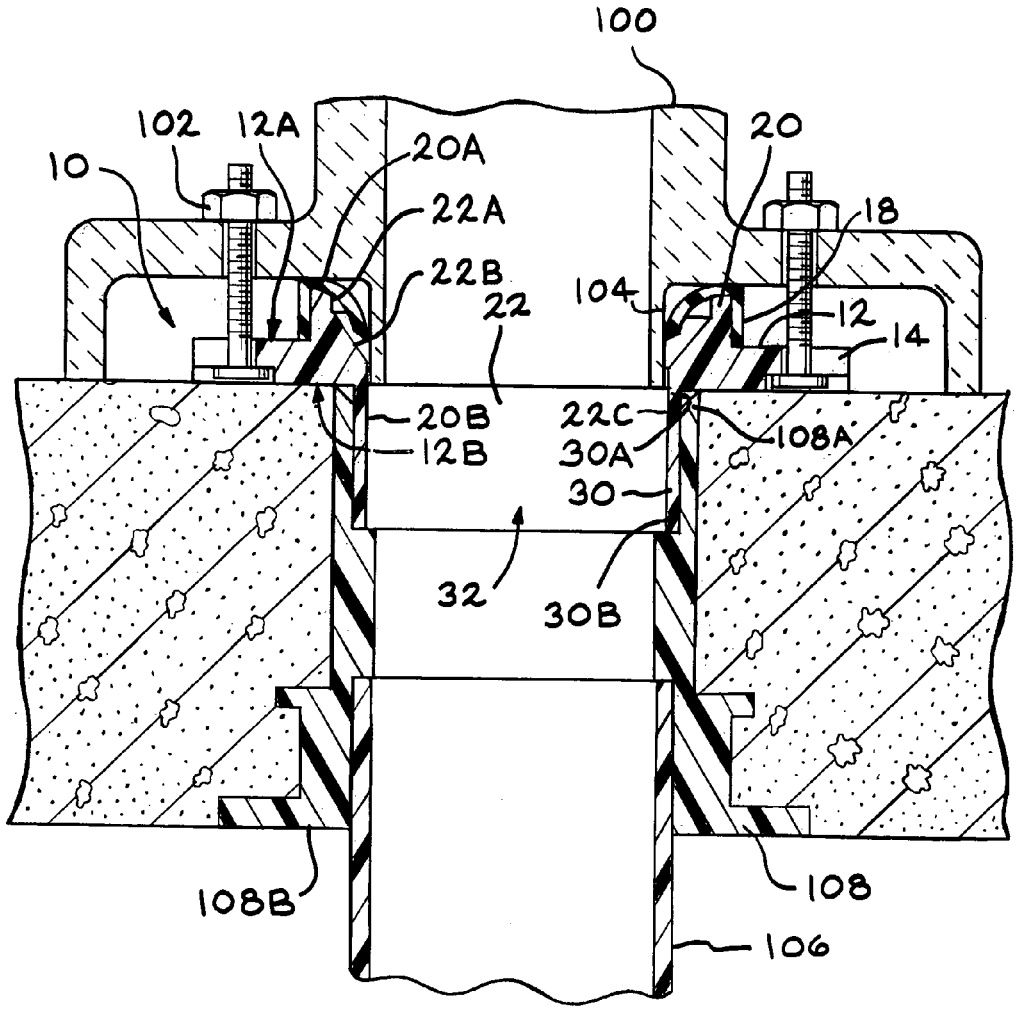
FIG. 3 is a cross-sectional view of the coupling 108 connected to the drain pipe 106 and the toilet 100.

FIGS. 1 to 3 show the flange assembly 10 of the present invention. The flange assembly 10 allows for connecting the waste outlet 104 of a plumbing fixture such as a toilet 100 to a drain pipe 106 of a sewer system (not shown). The flange assembly 10 includes a ring or flange 12, an extension 20, a gasket 24 and a connector pipe 30. In one (1) embodiment, the ring 12, extension 20 and connector pipe 30 are constructed as a unitary piece. In one (1) embodiment, the ring 12, extension 20 and connector pipe 30 are constructed of an essentially rigid material such as, for example, cast iron, ABS or PVC. In one (1) embodiment, the ring 12 has a circular shape with a circular center opening 18 and is similar in shape and size to standard toilet flanges (FIG. 2). The ring 12 has slots 14 for accommodating the toilet bolts 102 which are used to secure the toilet 100 to the ring 12. The ring 12 also has holes 16 which allow the toilet 100 to be mounted to the flange assembly 10 using other well known fasteners.

The extension 20 has a first end 20A and a second end 20B with a center bore 22 extending therebetween and is mounted at the second end 20B to the ring 12 adjacent and around the opening 18. The extension 20 extends outward from the top side of the ring 12. In one (1) embodiment, the extension 20 is positioned such that the opening 18 and the center bore 22 of the extension 20 are co-axial. The center bore 22 of the extension 20 tapers in diameter from the first end 20A to the second end 20B of the extension 20 (FIG. 1). Thus, the diameter of the center bore 22 adjacent the second end 20B is less than the diameter of the center bore 22 at the first end 20A. The center bore 22 of the extension 20 has a first section 22A adjacent the first end 20A of the extension 20, a second section 22B adjacent the second end 20B of the extension 20 and a third or middle section 22C spaced between the first and second sections 22A and 22B. The diameter of the first section 22A of the center bore 22 is greater than the diameter of the second section 22B of the center bore 22. The middle section 22C is tapered such that a diameter of the middle section 22C adjacent the first section 22A is essentially equal to a diameter of the first section 22A and a diameter of the middle section 22C adjacent the second section 22B is essentially equal to the diameter of the second section 22B. The diameter of the center bore 22 at the first end 20A of the extension 20 is greater than the outer diameter of the waste outlet 104 of the plumbing fixture. In one (1) embodiment, the diameter of the second section 22B of the center bore 22 of the extension 20 is essentially equal to the diameter of the center passageway of the drain pipe 106. In one (1) embodiment, the extension 20 extends beyond the top surface 12A of the ring 12 approximately 0.5 inches (1.3 cm).

The seal or gasket 24 is mounted on and over the extension 20. In one (1) embodiment, the gasket 24 includes a top wall 24A with a sidewall 24B extending outward from the bottom surface of the top wall 24A, perpendicular to the top wall 24A around the perimeter of the top wall 24A. The top wall 24A has an opening 26 which is in fluid communication with the center bore 22 of the extension 20 when the gasket 24 is correctly positioned on the extension 20. In one (1) embodiment, the extension 20 has a cylindrical outer shape and the gasket 24 has a cylindrical shape with the top wall 24A of the gasket 24 having a circular shape with a diameter equal to or slightly less than the outer diameter of the extension 20 at the first end 20A. It is understood that the shape of the top wall 24A of the gasket 24 corresponds to the outer shape of the extension 20 at the first end 20A such that the gasket 24 can be mounted over the first end 20A of the extension 20. In one (1) embodiment, the length of the sidewall 24B is essentially equal to the length of the extension 20 such that the gasket 24 covers the entire length of the extension 20 above the top surface 12A of the ring 12. In one (1) embodiment, the diameter of the top wall 24A is essentially equal to the inner diameter of the gasket 24 formed by the sidewall 24B and the inner diameter of the sidewall 24B of the gasket 24 is such that the sidewall 24B must be stretched to fit over the extension 20. The memory or resilient nature of the gasket 24 allows the gasket 24 to be stretched for mounting on the extension 20 and enables the gasket 24 to attempt to retract to its original size, thus causing a friction fit of the gasket 24 on the extension 20. In another embodiment, the inner diameter of the gasket 24 is slightly greater than the outer diameter of the extension 20 such that the gasket 24 is easily mounted over the first end 20A of the extension 20. In this embodiment, a solvent or adhesive is used to permanently mount the gasket 24 on the extension 20. Other means can also be used to secure the gasket 24 to the extension 20. When correctly positioned on the first end 20A of the extension 20, the top wall 24A of the gasket 24 extends partially over the opening 18 of the center bore 22 of the extension 20 at the first end 20A of the extension 20. The diameter of the opening 26 in the top wall 24A of the gasket 24 is less than the outer diameter of the waste outlet 104 of the toilet 100. A circular lip 28 is provided on the bottom surface 12A of the top wall 24A of the gasket 24 and extends around the circumference of the opening 26, spaced apart from the opening 26. In one (1) embodiment, the gasket 24 has a thickness of approximately 0.0625 inches (0.1588 cm). In one (1) embodiment, the gasket 24 is constructed of an essentially resilient material such as for example an elastomeric material, natural rubber or synthetic rubber.

The connector pipe 30 has a first end 30A and a second end 30B with a center bore 32 extending therethrough. The first end 30A of the connector pipe 30 is connected to the opening 18 of the ring 12. The connector pipe 30 extends outward from the second or bottom side 12B of the ring 12 in a direction opposite the extension 20. In one (1) embodiment, the connector pipe 30 has a cylindrical shape and is mounted on the ring 12 such as to be co-axial with the center opening 18 of the ring 12 and the center bore 22 of the extension 20. The connector pipe 30 is preferably permanently mounted to the ring 12. The diameter of the center bore 32 of the connector pipe 30 is preferably essentially equal to the inner diameter of the waste outlet 104. The connector pipe 30 can be of any length depending on the height of the floor 110. The outer diameter of the connector pipe 30 can also be varied. The outer diameter of the connector pipe 30 is preferably slightly less than the inner diameter of the drain pipe 106 such that the connector pipe 30 fits inside the drain pipe 106 and can be secured such as by an adhesive or solvent welding to the drain pipe 106. In one (1) embodiment, a coupler 108 is provided in the floor 110 with the drain pipe 106 connected to the lower or second end 108B of the coupler 108 (FIG. 3). In this embodiment, the outer diameter of the connector pipe 30 is slightly less than the inner diameter of the opening at the upper or first end 108A of the coupler 108.

To use the flange assembly 10 to connect a plumbing fixture to a drain pipe 106, the second end 30B of the connector pipe 30 of the assembly 10 is inserted into the first end of the drain pipe 106. In the embodiment having a coupler 108, the coupler 108 is secured in the floor 110 and the drain pipe 106 is connected to the second end 108B of the coupler 108. The second end 30B of the connector pipe 30 is then inserted into the first end 108A of the coupler 108. The connector pipe 30 is inserted into the drain pipe 106 or coupler 108 until the ring 12 touches the top surface of the floor 110. In the preferred embodiment, the first end of the drain pipe 106 or the first end 108A of the coupler 108, whichever is present, is flush with the floor 110. The connector pipe 30 is permanently secured in the drain pipe 106 or coupler 108. Once the flange assembly 10 is in place, the plumbing fixture is mounted on the flange assembly 10. In one (1) embodiment, the plumbing fixture is a toilet 100. However, it is understood that the flange assembly 10 can be used with any plumbing fixture having a waste outlet 104 where it is desirable to have a sealing relationship between the waste outlet 104 and the drain pipe 106. To mount the toilet 100 on the flange assembly 10, the toilet bolts 102 are moved into the slots 14 in the ring 12. Next, the toilet 100 is mounted on the flange assembly 10 such that the end of the waste outlet 104 is inserted into the opening 26 in the top wall 24A of the gasket 24. Since the waste outlet 104 has a diameter greater than the opening 26 of the gasket 24, the waste outlet 104 bends and pushes the gasket 24 inward as the waste outlet 104 is moved into the center bore 22 of the extension 20. The tapered, middle section 22C of the center bore 22 of the extension 20 tends to guide the waste outlet 104 toward the center of the center bore 22 of the extension 20. In one (1) embodiment, the waste outlet 104 is of such a length as to not extend beyond the middle section 22C of the center bore 22 of the extension 20. The difference in diameter of the opening 26 in the top wall 24A of the gasket 24 and the diameter of the center bore 22 of the extension 20 at the first end 20A of the extension 20 allows the gasket 24 to bend or flex gradually as the waste outlet 104 is inserted. This helps to eliminate the wear on the gasket 24 which could be caused if the gasket 24 were required to make a sharp bend. Once the end of the waste outlet 104 is beyond the top wall 24A of the gasket 24, the gasket 24 forms a fluid tight seal between the extension 20 and the waste outlet 104 of the toilet 100. Thus, no gases or liquids can escape between the flange assembly 10 and the outer surface of the waste outlet 104. The seal is formed prior to securing the toilet 100 to the flange assembly 10 using the toilet bolts 102. However, once the toilet 100 is correctly positioned, the toilet 100 is secured to the flange assembly 10. Securing the toilet 100 to the flange assembly 10 reduces the risk of accidental removal of the waste outlet 104 from the gasket 24 which would eliminate the sealing relationship between the flange assembly 10 and the waste outlet 104.

The flexible nature of the gasket 24 enables the gasket 24 to flex as the waste outlet 104 is moved into the center bore 22 of the extension 20 without damage to the gasket 24. The resilient nature of the gasket 24 causes the gasket 24 to continually try to regain its normal shape. Thus, the gasket 24 pushes against the outer surface of the waste outlet 104. This helps to create the fluid tight seal between the waste outlet 104 and the flange assembly 10. The memory quality and flexible nature of the gasket 24 allows the gasket 24 to be reused if the toilet 100 is removed and replaced. When the toilet 100 is removed, the waste outlet 104 is removed from the extension 20 and the gasket 24. Once the waste outlet 104 has been removed, the gasket 24 returns to its original configuration. The flange assembly 10 is then ready to receive a new toilet 100. However, if necessary, the gasket 24 can be removed from the extension 20 and replaced with a new gasket 24.

It is intended that the foregoing description be only illustrative of the present invention and that the present invention be limited only by the hereinafter appended claims.

What is claimed is:

1. A flange assembly for use in connecting a plumbing fixture to a drain pipe, which comprises:

(a) a flange having a first side and a second side with an opening extending between the sides wherein the flange assembly is mounted on the drain pipe such that the drain pipe is in fluid communication with the opening of the flange adjacent the second side of the flange and extends outward away from the second side of the flange in a direction opposite the first side of the flange;

(b) an extension having a first end and a second end with an outer surface extending along a length of the extension between the first and second ends, the second end of the extension mounted on the first side of the flange, the extension extending outward toward the first end of the extension beyond the first side of the flange in a direction opposite the second side of the flange and the drain pipe and having a center bore in fluid communication with the opening of the flange; and (c) a gasket having a top wall and a sidewall and mounted on the outer surface of the extension such that the sidewall of the gasket extends along and is in contact with the length of the outer surface of the extension between the first and second ends of the extension and the top wall extends over the first end of the extension and covers a portion of the center bore of the extension and having an opening in fluid contact with the center bore of the extension wherein in use, the plumbing fixture is positioned on the flange assembly with a waste outlet of the plumbing fixture extending through the opening in the gasket and into the center bore of the extension such that the gasket forms a fluid tight seal between the waste outlet of the plumbing fixture and the center bore of the extension.

2. The flange assembly of claim 1 wherein the center bore of the extension has a first end opposite the flange and a second end adjacent the flange and wherein the center bore of the extension is tapered so that a diameter of the center bore at the first end is greater than a diameter of the center bore at the second end.

3. The flange assembly of claim 1 wherein the center bore of the extension has a first end opposite the flange and a second end adjacent the flange and wherein the center bore of the extension has a first section adjacent the first end, a second section adjacent the second end and a middle section extending between the first and second sections, wherein a diameter of the first section is greater than a diameter of the second section and wherein the middle section is tapered such that a first diameter of the middle section adjacent the first section is essentially equal to the diameter of the first section and a second diameter of the middle section adjacent the second section is essentially equal to the diameter of the second section and wherein in use the tapered middle section assists in guiding the waste outlet of the plumbing fixture during positioning of the plumbing fixture on the flange assembly.

4. The flange assembly of claim 1 wherein a diameter of the opening of the gasket is configured to be less than an outer diameter of the waste outlet of the plumbing fixture.

5. The flange assembly of claim 1 wherein the gasket covers an entire length of the extension between the first and second ends of the extension.

6. The flange assembly of claim 1 wherein the gasket has a lip extending around a circumference of the opening on an inner side of the gasket adjacent the center bore of the extension.

7. The flange assembly of claim 1 wherein the gasket is constructed of a resilient material.

8. The flange assembly of claim 7 wherein the gasket is constructed of an elastomeric material.

9. A toilet flange assembly for connecting a toilet to a drain pipe, which comprises:

(a) a ring having a first side and a second side with an opening extending between the sides;

(b) a connector pipe having a first end and a second end with the first end connected to the opening of the ring adjacent the second side of the ring and extending outward from the second side of the ring in a direction opposite the first side of the ring;

(c) an extension having a first end and a second end with an outer surface extending along a length of the extension between the first and second ends, the second end connected to the ring adjacent the first side of the ring and extending outward from the first side of the ring in a direction opposite the second side of the ring and the connector pipe and having a center bore in fluid communication with the opening of the ring; and (d) a gasket having a top wall and a sidewall and mounted on the outer surface of the extension such that the sidewall of the gasket extends along and is in contact with the length of the outer surface of the extension between the first and second ends of the extension, wherein the top wall of the gasket extends over the first end of the extension opposite the ring and has an opening, the opening having a diameter less than a diameter of the center bore of the extension at the first end of the extension wherein in use, the connector pipe is connected to the drain pipe and the toilet is positioned on the flange assembly with a waste outlet of the toilet extending through the opening of the gasket and into the center bore of the extension such that the gasket forms a fluid tight seal between the waste outlet of the toilet and the center bore of the extension.

10. The flange assembly of claim 9 wherein the center bore of the extension is tapered so that a diameter of the center bore adjacent the first end of the extension is greater than a diameter of the center bore adjacent the second end of the extension.

11. The flange assembly of claim 9 wherein the center bore of the extension has a first section adjacent the first end of the extension, a second section adjacent the second end of the extension and a middle section extending between the first and second sections, wherein a diameter of the first section is greater than a diameter of the second section and wherein the middle section is tapered such that a first diameter of the middle section adjacent the first section is essentially equal to the diameter of the first section and a second diameter of the middle section adjacent the second section is essentially equal to the diameter of the second section and wherein in use the tapered middle section assists in guiding the waste outlet of the toilet during positioning of the toilet on the flange assembly.

12. The flange assembly of claim 11 wherein the connector pipe has a center bore and wherein the diameter of the second section of the center bore of the extension is essentially equal to a diameter of the center bore of the connector pipe.

13. The flange assembly of claim 9 wherein the connector pipe has a center bore and wherein the diameter of the opening of the gasket is less than a diameter of the center bore of the connector pipe.

14. The flange assembly of claim 9 wherein a diameter of the opening of the gasket is configured to be less than an outer diameter of the waste outlet of the toilet.

15. The flange assembly of claim 9 wherein the gasket covers an entire length of the extension between the first and second ends of the extension.

16. The flange assembly of claim 9 wherein the ring, extension and connector pipe are a unitary piece.

17. The flange assembly of claim 9 wherein the gasket has a lip extending around a circumference of the opening on an inner side of the gasket adjacent the center bore of the extension.

18. The flange assembly of claim 9 wherein the gasket is constructed of a resilient material.

19. The flange assembly of claim 18 wherein the gasket is constructed of an elastomeric material.

20. The flange assembly of claim 9 wherein an outer diameter of the connector pipe is configured to fit within the drain pipe.

21. A method for forming a fluid seal between a waste outlet of a toilet and a drain pipe which comprises the steps of:

(a) providing a flange assembly including a ring having a first side and an opposed second side with an opening extending between the sides, an extension having a first end and a second end with an outer surface extending along a length of the extension between the first and second ends, the second end of the extension mounted on the first side of the flange and extending outward toward the first end of the extension beyond the first side of the ring in a direction opposite the second side of the ring and having a center bore in fluid contact with the opening of the ring, and a gasket having a top wall and a sidewall and having an opening;

(b) mounting the gasket on the outer surface of the extension so that the sidewall of the gasket extends along and in contact with the length of the outer surface of the extension between the first and second ends of the extension and the top wall extends over the first end of the extension so that the opening of the gasket is in fluid communication with the center bore of the extension;

(c) connecting the opening of the ring to the drain pipe such that the drain pipe is adjacent the second side of the ring and extends outward in a direction opposite the extension; and (d) mounting the toilet on the assembly such that the waste outlet of the toilet extends into the center bore of the extension wherein the gasket flexes to accommodate the outlet and forms a fluid tight seal between the waste outlet of the toilet and the flange assembly.

22. The method of claim 21 wherein a coupling is provided having a first end and a second end and wherein in step (b), the drain pipe is connected to the second end of the coupling and the first end of the coupling is connected to the opening of the ring such that the coupling is adjacent the second side of the ring.

23. The method of claim 22 wherein prior to step (b), the coupling is mounted in a floor and wherein after step (b), the ring is secured to the floor.

* * * * *